United States Patent [19]

Lefton

[11] 3,991,638

[45] Nov. 16, 1976

[54] RAIL GUN GAUGE ASSEMBLY AND METHOD

[76] Inventor: Benjamin B. Lefton, 9912 Warshire, Creve Coeur, Mo. 63132

[22] Filed: Dec. 2, 1975

[21] Appl. No.: 637,020

[52] U.S. Cl. ..... 83/50; 30/361; 30/DIG. 4; 83/745; 83/639

[51] Int. Cl.[2] ..... B26F 1/02

[58] Field of Search ..... 83/50, 745, 639, 559, 83/560; 30/DIG. 4, 358, 361; 33/174 H, 189, 192, 174 R

[56] References Cited

UNITED STATES PATENTS

| | | | |
|---|---|---|---|
| 2,302,646 | 11/1942 | Temple | 30/DIG. 4 |
| 3,893,239 | 7/1975 | Giebel et al. | 30/361 X |

*Primary Examiner*—Frank T. Yost
*Attorney, Agent, or Firm*—Polster and Polster

[57] ABSTRACT

In the combination of a railroad rail and a rail-piercing gun having a support area extending across the tread of the rail, a gauge is provided which includes a rail-end stop bearing against an end of the rail, and an elongated saddle bar connected to the stop, and having in a side away from the tread of the rail a plurality of seats spaced a distance equal to the desired lengthwise spacing of fish plate bolt holes to be formed by the gun, of a length and depth to accommodate closely the gun support area and of a height from the tread to locate the gun at the desired position heightwise of the web of the rail. In the use of the gauge, the gauge is placed on the rail, the gun is seated in a seat whereby the saddle bar is held in position laterally of the tread, the gun is moved away from the stop end of the gauge until the stop engages the end of the rail, a hole is formed with the gun, the gun is moved to another seat and the process is repeated.

4 Claims, 3 Drawing Figures

RAIL GUN GAUGE ASSEMBLY AND METHOD

BACKGROUND OF THE INVENTION

In laying out small switch yards or spurs, and in repairing existing tracks by replacing short sections of rail, it is often necessary or desirable to use rails which are not provided at one or both ends with bolt holes to receive the fish plates or rail plates by which the rail is to be connected to a contiguous rail. Among common present practices, a C-shaped rail-piercing gun is used with a barrel arm on one side of the web of the rail and a back-up arm or anvil on the other side of the web, and a cross member extending across the tread of the rail. As presently used, the desired positions of the bolt holes are established by measuring lengthwise from the end of the rail and marking a chalk line. The elevation of the gun is then sighted visually so that the hole will be shot in the middle of the web. The space between the gun and the top surface of the head of the rail is then shimmed so as to provide a stable mounting for the rail gun. This process is repeated for each hole, which makes for a time-consuming and difficult task.

One of the objects of this invention is to provide means for forming fish plate bolt holes in the web of a rail quickly, easily, and accurately.

Other objects will become apparent to those skilled in the art in the light of the foregoing description and accompanying drawings.

SUMMARY OF THE INVENTION

In accordance with this invention, generally stated, in the combination of a railroad rail having a tread, a web, and a foot, and a rail-piercing gun having a support area extending across the tread of the rail, a gauge is provided which includes a rail-end stop bearing against an end of the rail and an elongate saddle bar connected to the stop, the saddle bar resting on the outer surface of the tread and having in its side away from the tread a plurality of seats spaced therealong a distance equal to the desired lengthwise spacing of the fish plate bolt holes to be formed by the gun, being of a length and depth to accommodate closely the gun support area and of a height from the outer surface of the rail tread to locate the gun at the desired position heightwise of the web between the tread and the foot of the rail. In the preferred embodiment, the saddle bar is a single rectangular bar milled to provide seats with flat bottom surfaces and flat side surfaces perpendicular thereto, the saddle bar has a flat end face perpendicular to the tread-engaging surface of the saddle bar, and the rail end stop is removably mounted on that face.

In the method of forming holes in the web, in which the gauge of the invention is used, the saddle bar of the gauge is set on the tread, the gun is seated in one of the seats thereby to maintain the saddle bar in position laterally on the tread, and a force is exerted on the gun in a direction away from the stop end until the stop engages the rail end; a hole is formed with the gun, the gun is moved to another seat, and the process is repeated.

DESCRIPTION OF THE PREFERRED EMBODIMENT

Figure 1:
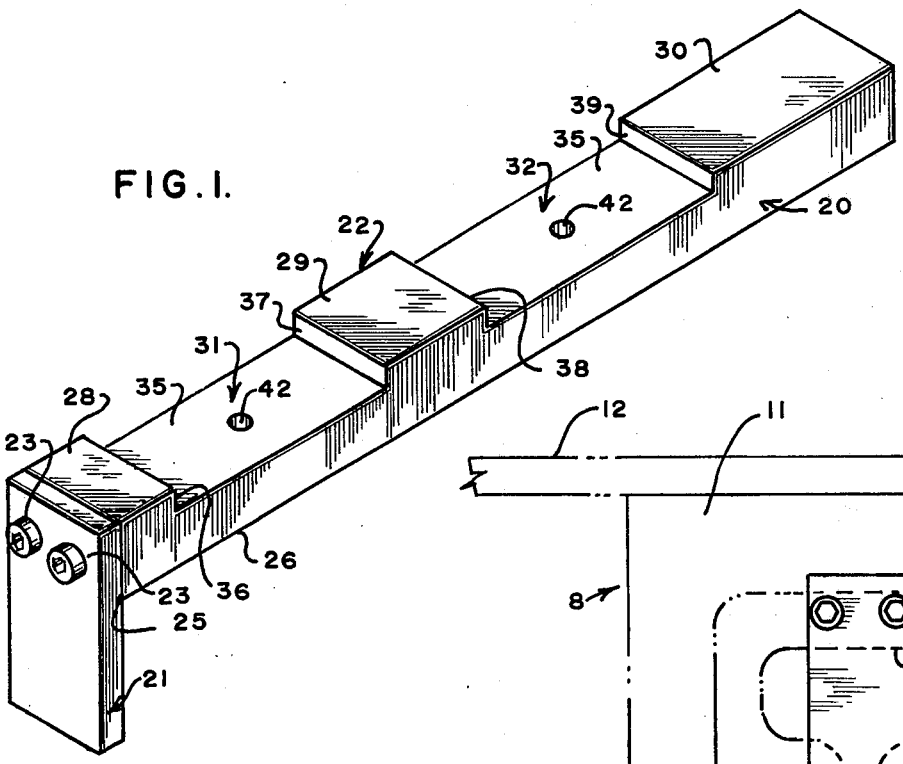
FIG. 1 is a view in perspective of one illustrative embodiment of gauge of this invention.
Figure 2:
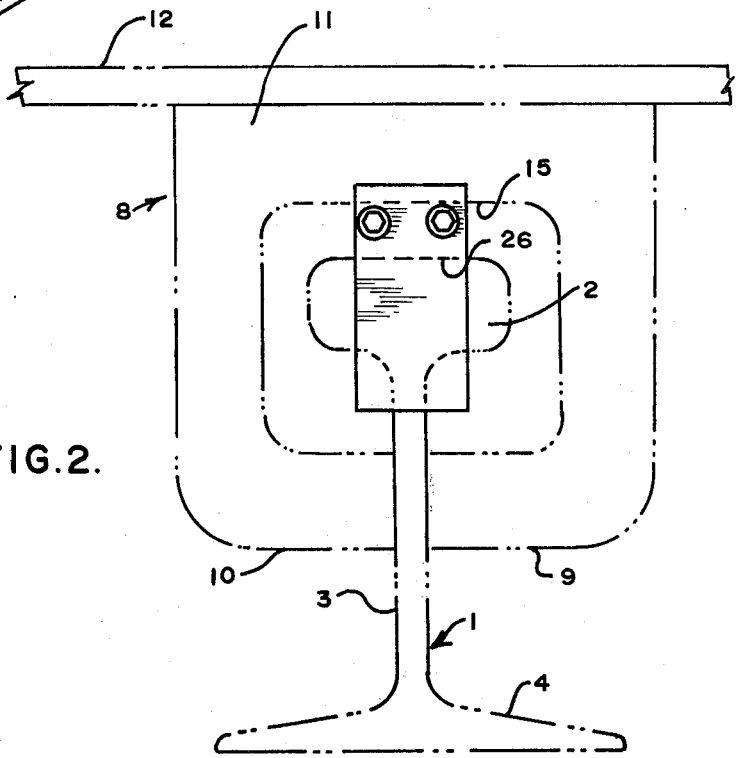
FIG. 2 is a view in end elevation of the gauge shown in FIG. 1 mounted on a rail, and with a rail-piercing gun mounted on the gauge and rail.

Referring now to the drawings for one illustrative embodiment of rail gauge of this invention, reference numeral 1 indicates a railroad rail to be pierced. The rail 1 has a tread 2, a web 3, and a foot 4.

A rail-piercing gun 8, C-shaped in side elevation, has a barrel arm 9, a back-up arm or anvil 10, a cross member 11 and a handle 12. The gun 8 is conventional, as for example the model T-140 "rail web punch" sold by Mine Safety Appliances Company of Pittsburgh, Pa., Part No. 449170. The inner surface of the cross member 11 has on it a seat area 15 which is rectangular and flat, and has substantially parallel side faces. Both the track and the gun are conventional.

A gauge 20 includes a rail end stop 21 and a saddle bar 22. In this embodiment, the saddle bar has a flat end face 25 with drilled and tapped sockets to receive studs 23, which extend through holes in the stop 21 and are screwed down tightly to mount the stop 21 tightly on but selectively demountably from the saddle bar. In this embodiment, the end face 25 of the saddle is perpendicular to a flat rail tread engaging surface 26 and the stop itself is flat-sided, depending perpendicularly from and substantially beyond the flat surface 26.

Figure 3:
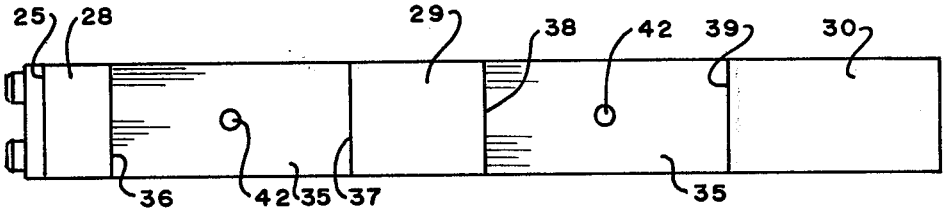
FIG. 3 is a top plan view of the gauge shown in FIGS. 1 and 2.

A surface of the rectangular saddle bar opposite the tread-engaging surface 26 is milled to form lands 28, 29 and 30 and saddles or seats 31 and 32 defined by bottom surfaces 35 and, successively from the stop end, vertical surfaces 36, 37, 38 and 39. As can be seen from FIGS. 1 and 3, the vertical surface 36 delineates one edge of the land 28; the vertical surface 37 facing the surface 36 defines one edge of the land 29; the vertical surface 38 defines the other edge of the land 29, and the vertical surface 39, facing the vertical surface 38, forms one edge surface of the land 30.

In the embodiment shown, holes 42 are formed entirely through the saddle bar, in the center of each seat.

In use, the saddle bar is placed on top of the tread of the rail, and the seat area of the cross arm 11 is seated in one of the saddles or seats 31 and 32. The dimensions of the seat area and of the gun are such that the seating of the gun effectively anchors the gauge against movement transversely of the tread. The gauge is biased in the direction away from the stop to ensure that the stop engages the end of the rail firmly, and the gun is fired to form a hole. The gun is then placed in the other of the saddles or seats and, when the stop 21 is firmly against the end of the rail, the gun is fired again to form a second hole, spaced, by virtue of the spacing of the seats, at exactly the desired lengthwise spacing of the holes to accommodate the holes of an appropriate fish plate.

A single gauge will satisfy the requirements for gauging any and all rails of one set of dimensions for which fish plates of the same dimensions are used. However, it can be seen that for different heights of rail or different styles of fish plates or rail plates, gauges with seats of different height or of different spacing, or both, as with more than two seats can be provided. In any event, once the appropriate gauges are made, they eliminate the need for measuring to locate each of the holes, for shimming the gun each time to the desired height, and for holding the gun at the marked location lengthwise of the rail, all of which characterizes the methods now in common use.

Merely by way of illustration, and not of limitation, a gauge suitable for use with certain existing rails and fish plates, can have a saddle bar 12 inches long, 1½ inches wide and 1 inch thick, with two saddles each 3¼ inches long and 3/16 inch deep, making the height from the rail engaging surface to the bottom surface of the saddle 13/16 inch. The stop can be 1 inch wide, centered widthwise of the end of the saddle bar, ¼ of an inch thick and 3 inches long, mounted with the top flush with the top edge of the saddle bar, so that the stop projects 2 inches below the rail engaging surface of the saddle bar. The distance from the inside surface of the step to the center of the saddle nearest the stop is 2½ inches, and the center of the more remote saddle, 7½ inches, making the center to center spacing of the saddles 5 inches. In a somewhat heavier rail, a typical gauge will have three saddles, a saddle bar 18 inches long, 1½ inches wide and 1 inch thick. The dimensions of the stop can be the same as in the first illustration. The distance from the rail engaging surface to the bottom of each saddle is ⅜ inch, the distance from the inside surface of the stop to the center of the saddle nearest the stop is 2½ inches, the center to center spacings of the three saddles is 6½ inches, and the saddles themselves are 3¼ inches long. As has been indicated, these are merely illustrative of dimensions of useful gauges, but the gauges can be made to any desired dimensions to suit different rail requirements.

Numerous variations in the construction of the device of this invention, within the scope of the appended claims, will occur to those skilled in the art in the light of the foregoing disclosure. Merely by way of example, the saddles or seats 31 and 32 can be made with outwardly divergent sides to facilitate seating of the gun or to accommodate a gun seat area which is defined on its sides by chamfers. The number and spacing of the seats or saddles can be varied, as has been indicated. Various other means for mounting or securing the stop to the saddle bar can be provided. Instead of a hole 42, the seat area can be cut away to form or be defined by side bars, or the saddle bar can be fabricated from separate elements. The lands can be defined by pins or blocks fastened in or to a flat plate. The gun can take the form of a C-shaped drill. These variations are merely illustrative.

Having thus described the invention, what is claimed and desired to be secured by Letters Patent is:

1. In the combination of a railroad rail having a tread, a web, and a foot, and a rail-piercing gun having a support area extending across the tread of said rail, the improvement comprising a gauge comprising a rail-end stop bearing against an end of said rail and an elongate saddle bar connected to said stop, said saddle bar resting on the outer surface of said tread and having in its side away from said tread a plurality of seats spaced therealong a distance equal to the desired lengthwise spacing of fish plate bolt holes, of a length and depth to accommodate closely said gun support area, and of a height from said outer surface of the rail tread to locate the gun at the desired position heightwise of the web between the tread and the foot of the rail.

2. The improvement of claim 1 wherein the saddle bar is a single rectangular bar milled to provide said seats with flat bottom surfaces and flat side surfaces perpendicular thereto.

3. The improvement of claim 1 wherein the saddle bar has a flat end face perpendicular to the tread engaging surface of the saddle bar and the rail end stop is removably mounted on said face.

4. The method of forming holes in the web of a railroad rail having a tread, web and foot comprising placing on the tread of said rail at an end thereof a gauge having a rail-end stop and a saddle bar having a plurality of seats in it; seating a web perforating gun in one of said seats and thereby maintaining said saddle bar in position laterally on said tread, exerting a force on said gun sufficient to move said gun in a direction away from said end until said rail-end stop engages said rail end, forming a hole with said gun, moving said gun to another seat and repeating the process.

* * * * *